US011006222B2

(12) United States Patent
Chen et al.

(10) Patent No.: US 11,006,222 B2
(45) Date of Patent: May 11, 2021

(54) SPEAKER

(71) Applicant: AAC Technologies Pte. Ltd., Singapore (SG)

(72) Inventors: Minmin Chen, Shenzhen (CN); Xun Di, Shenzhen (CN); Bin Zhao, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/702,590

(22) Filed: Dec. 4, 2019

(65) Prior Publication Data

US 2020/0213751 A1 Jul. 2, 2020

(30) Foreign Application Priority Data

Dec. 30, 2018 (CN) ..... 201811645415.9

(51) Int. Cl.

| | |
|---|---|
| ***H04R 25/00*** | (2006.01) |
| ***H04R 9/06*** | (2006.01) |
| ***H04R 1/02*** | (2006.01) |

(52) U.S. Cl.

CPC ..... *H04R 9/06* (2013.01); *H04R 1/02* (2013.01); *H04R 2400/11* (2013.01); *H04R 2499/11* (2013.01)

(58) Field of Classification Search

CPC combination set(s) only.
See application file for complete search history.

(56) References Cited

U.S. PATENT DOCUMENTS

2006/0280330 A1* 12/2006 Watanabe ..... H04R 9/022 381/397
2007/0237352 A1* 10/2007 Andersen ..... H04R 9/025 381/414

* cited by examiner

*Primary Examiner* — Amir H Etesam
(74) *Attorney, Agent, or Firm* — W&G Law Group LLP

(57) ABSTRACT

The present disclosure discloses a speaker, including a holder, a magnetic circuit unit and a vibration unit arranged in the holder, the vibration unit comprises a suspension fixed at the holder, a dome fixed at a center of the suspension and a voice coil connected to the dome, the dome is provided with recesses formed by recessing from the dome towards the magnetic circuit unit, a spacing is formed between at least two of the recesses, and the voice coil abuts against bottom walls of the recesses and forms a leakage passage with the dome at the spacing. The leakage passage enables a difference of internal and external air pressures of the voice coil to be effectively reduced after an amplitude of the vibration unit is increased; the voice coil becomes short and thick, and thus a magnetic flux is increased and structural strength of the dome itself is improved.

14 Claims, 6 Drawing Sheets

SPEAKER

TECHNICAL FIELD

The present disclosure relates to the field of electroacoustic conversion, and in particular, to a speaker.

BACKGROUND

With the continuous increase of market demands, electronic devices such as mobile phones are gradually developing towards a thin type, and requiring better and better sound quality, which requires that acoustic devices in mobile phones develop towards a direction of miniaturization, thinning and high sound quality. A diaphragm is a core component of the acoustic devices such as a speaker, and thus also has an improved requirement on its acoustic performance.

The speaker in the related art includes a holder, and a magnetic circuit unit and a vibration unit that are provided in the holder. The vibration unit includes a diaphragm fixed to the holder and a voice coil connected to the diaphragm. The voice coil is inserted into a magnetic gap of the magnetic circuit unit and directly abuts against the diaphragm. In this speaker, since the voice coil directly abuts against the diaphragm and the two completely fits to each other at an abutting position, in order to ensure sufficient space between a yoke and a dome in a process of thinning of the speaker, the voice coil needs to be elongated to ensure a magnetic flux, whereas more space is required when an amplitude of the diaphragm becomes larger, and air flow in the voice coil cannot be circulated in time. Moreover, strength of a conventional alloy dome is insufficient, which affects and degrades the performance of the speaker.

Therefore, it is necessary to provide a new technical solution to overcome the above technical problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

Figure 1:
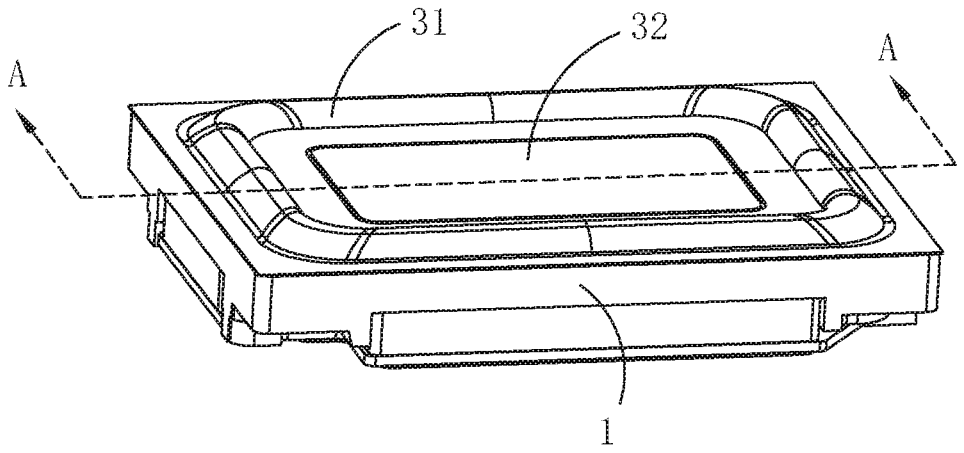
FIG. 1 is a perspective structural diagram of a speaker according to an embodiment of the present disclosure.
Figure 2:
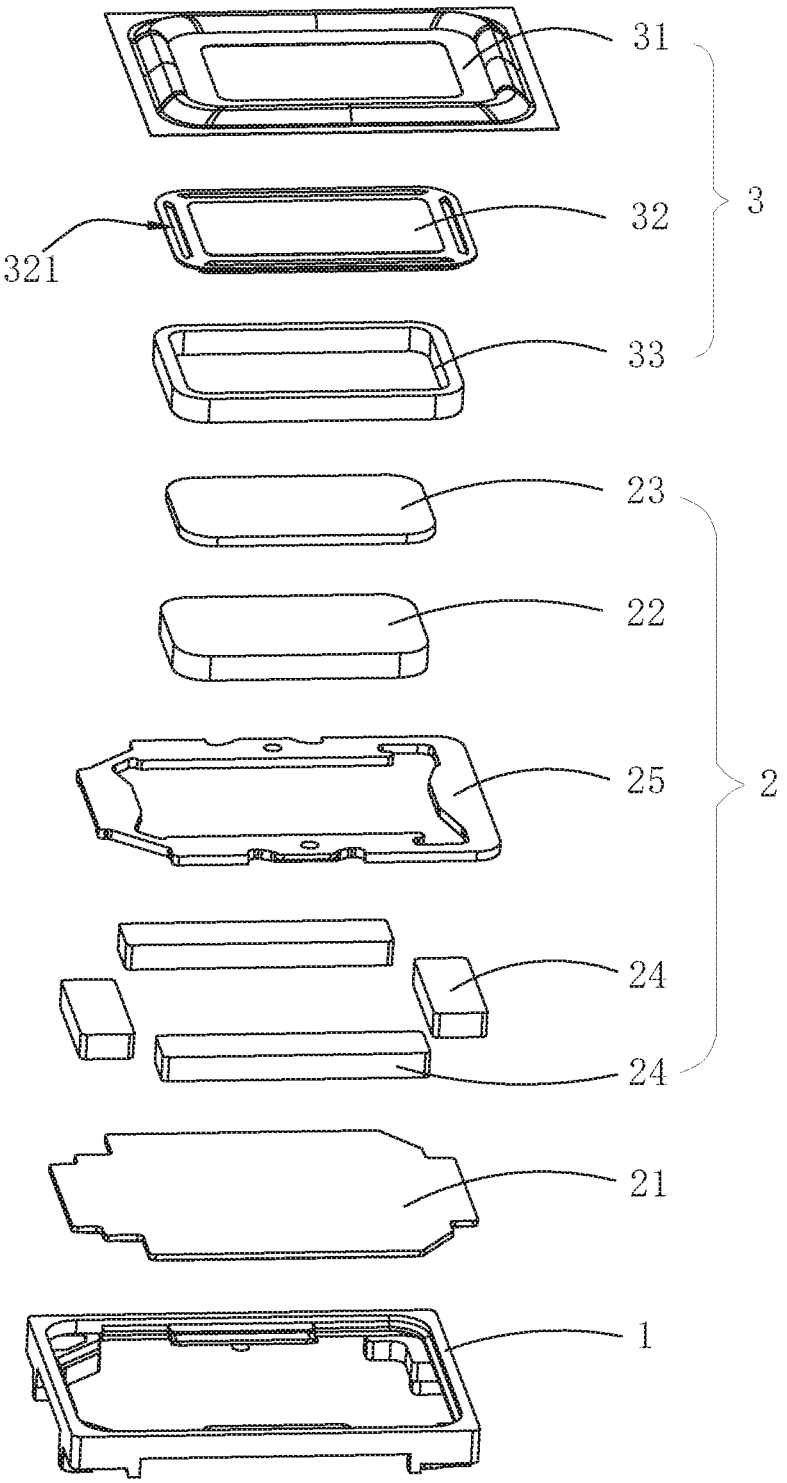
FIG. 2 is an exploded perspective structural diagram of a speaker according to an embodiment of the present disclosure.
Figure 3:
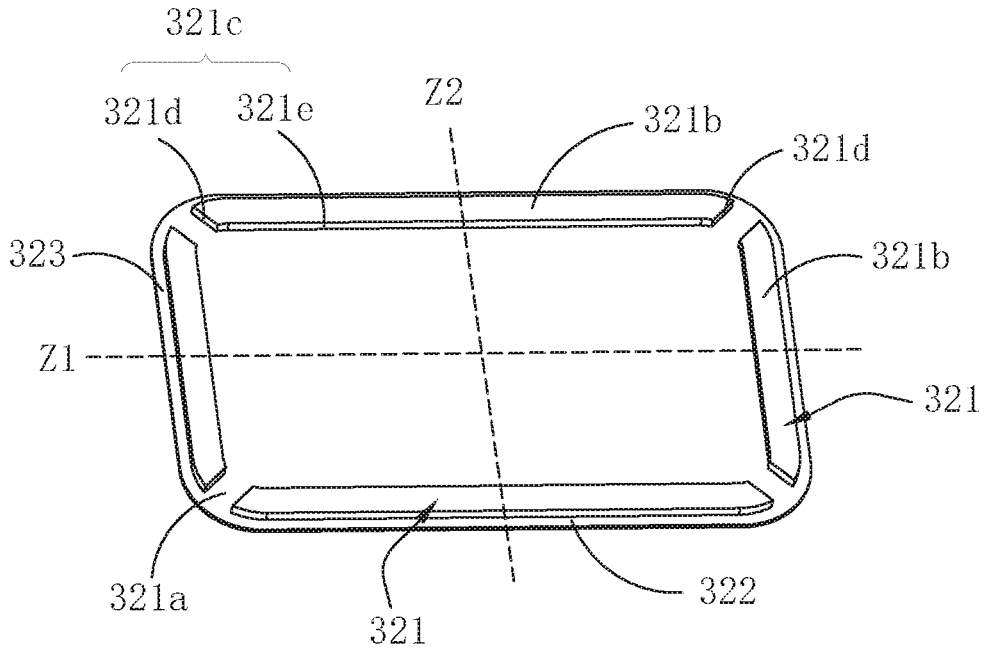
FIG. 3 is a structural diagram of a dome of a speaker according to an embodiment of the present disclosure.
Figure 4:
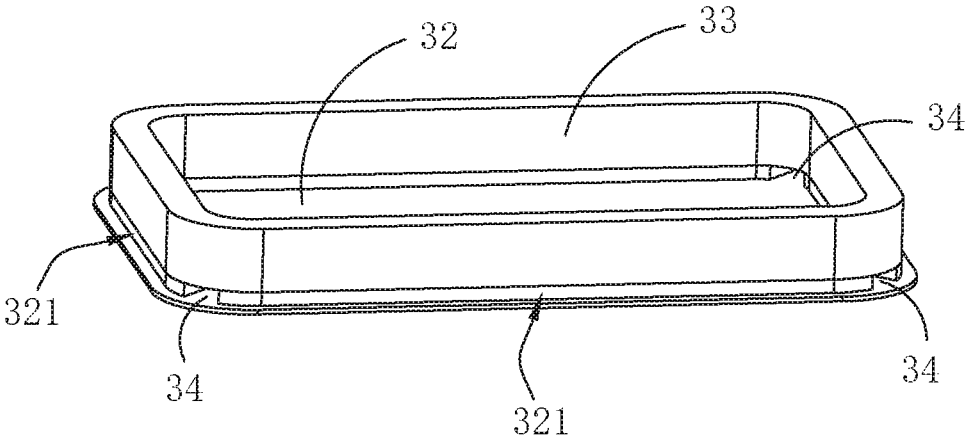
FIG. 4 is a structural diagram of a combination of a dome and a voice diaphragm of a speaker according to an embodiment of the present disclosure.
Figure 5:
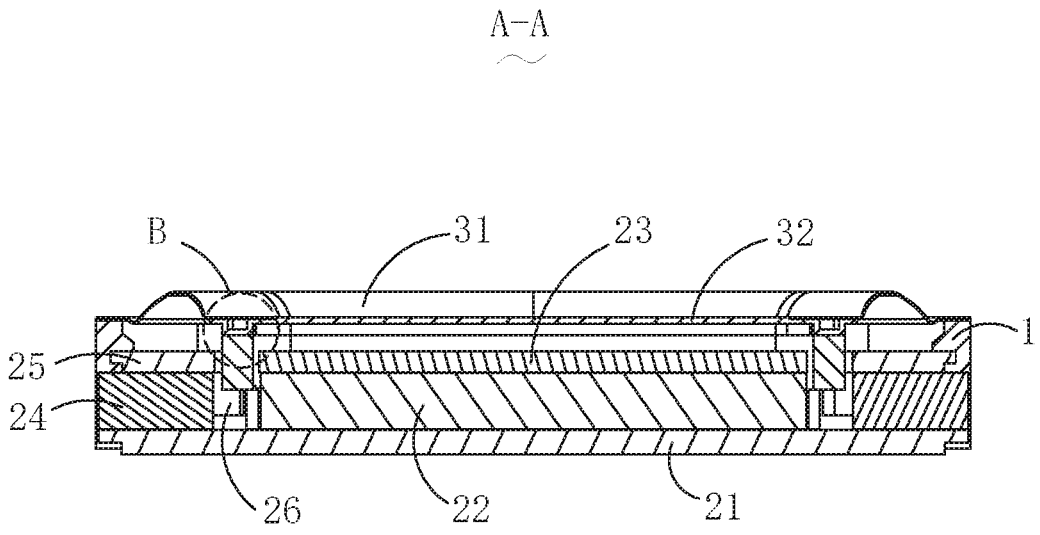
FIG. 5 is a cross-sectional diagram taken along direction A-A of FIG. 1.
Figure 6:
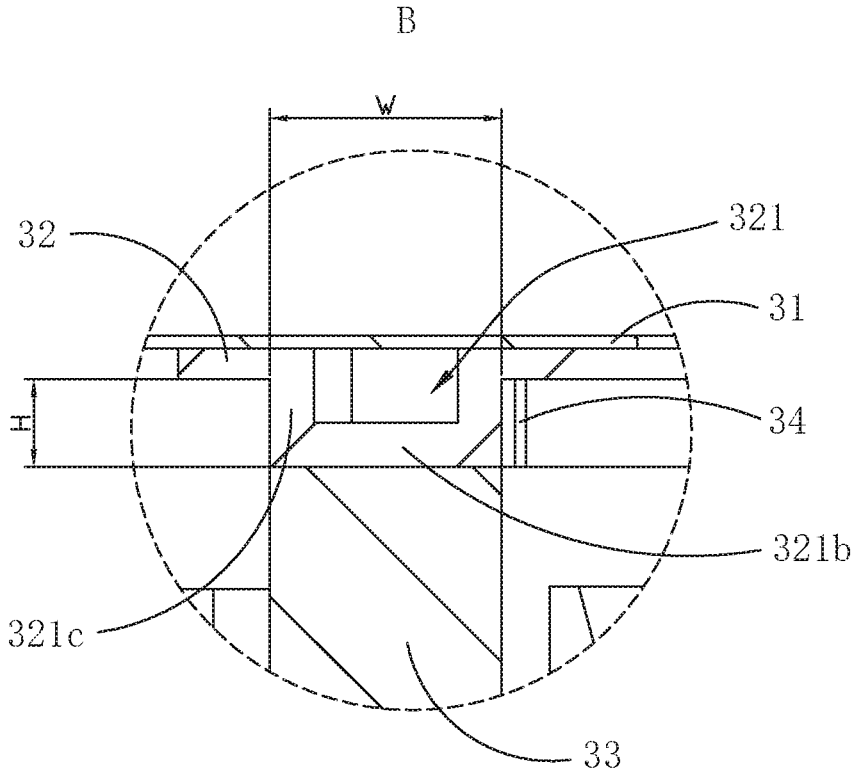
FIG. 6 is an enlarged diagram of a portion B shown in FIG. 5.

The present disclosure will be further illustrated with reference to the accompanying drawings and the embodiments.

FIGS. 1-6 show a structure of a speaker according to embodiments of the present disclosure. The speaker includes a holder 1, a magnetic circuit unit 2 and a vibration unit 3, and the magnetic circuit unit 2 and the vibration unit 3 are arranged in the holder 1. The magnetic circuit unit 2 includes a yoke 21, a main magnet 22 provided in the yoke 21, a magnetic conductive plate 23 provided above the main magnet 22, an auxiliary magnet 24 surrounding the main magnet 22, and an upper clamping plate 25 provided above the auxiliary magnet 24. A magnetic gap 26 is formed between the main magnet 22 and the auxiliary magnet 24.

The vibration unit 3 includes a suspension 31 fixed at the holder 1, a dome 32 fixed at a center of the suspension 31, and a voice coil 33 connected to the dome 32. A plurality of recesses 321 formed by recessing from the dome 32 towards the magnetic circuit unit 2 is provided in the dome 32. A spacing 321*a* is formed between at least two recesses 321 of the plurality of recesses 321. The recess 321 includes a bottom wall 321*b* close to the magnetic circuit unit 2. The voice coil 33 has one end abutting against the bottom wall 321*b* of the recess 321 and another end inserted into the magnetic gap 26, and forms a leakage passage 34 with the dome 32 at the position of the spacing 321*a*.

In the above structure, the dome 32 is fixed to the center of the suspension 31. That is, the dome 32 can be fixed to a side of the suspension 31 facing away from the magnetic circuit unit 2, or otherwise be fixed to a side of the suspension 31 close to the magnetic circuit unit 2. The voice coil 33 is bonded to the bottom walls 321*b* of the recesses 321 in the dome 32 by a glue, and no glue is applied at the position of the leakage passage 34 in order to prevent the glue from clogging the leakage passage 34. One or more leakage passages 34 are formed. Since the voice coil 33 abuts against the bottom wall 321*b* of the recess 321 and forms the leakage passage 34 with the dome 32 at the position where the recesses 321 forms the spacing 321*a*, the arrangement of the leakage passage 34 enables air flow in the voice coil 33 to be circulated in time through the leakage passage 34, which can effectively reduce a difference between internal and external air pressures of the voice coil 33 after an amplitude of the vibration unit 3 is increased, thereby avoiding an influence of an imbalance of the internal and external air pressures of the voice coil 33 on the performance of the speaker, compared with a structure in the related art where the voice coil directly abuts against the diaphragm and the two completely fit to each other at the abutting position. Moreover, the arrangement of the recesses 321 occupies a part of space where the voice coil 33 is originally placed, and the voice coil 33 becomes short and thick, which reduces a thickness of the speaker while increasing a magnetic flux. Further, the arrangement of the recesses 321 in the dome 32 also enhances structural strength of the dome 32 itself.

In an embodiment, the dome 32 is a rounded rectangular structure, and includes long-axis edges 322 that are oppositely arranged and short-axis edges 323 connecting the long-axis edges 322. The recesses 321 are provided in rims of the long-axis edge 322 and the short-axis edge 323 of the dome 32, and the spacing 321*a* is located between two adjacent recesses 321. The recess 321 includes sidewalls 321*c* extending from the dome 32 towards the magnetic circuit unit 2, and a bottom wall 321*b*, and the sidewalls

321*c* and the bottom wall 321*b* together define the recess 321. The sidewalls 321*c* include two first sidewalls 321*d* oppositely arranged and inclined towards a geometric center of the dome 32, and second sidewalls 321*e* connecting the first sidewalls 321*d*. Planes in which the two first sidewalls 321*d* are located intersect inside the dome 32.

Further, four recesses 321 are provided, the four recesses 321 are respectively located in the two long-axis edges 322 and the two short-axis edges 323 of the dome 32, and each recess 321 is parallel with the long-axis edge 322 or the short-axis edge 323 where it is located. In addition, the two recesses 321 located in the long-axis edges 322 are symmetrically distributed about a perpendicular bisector Z1 of the short-axis edges 323, and the two recesses 321 located in the short-axis edges 323 are symmetrically distributed about a perpendicular bisector Z2 of the long-axis edges 322. The voice coil 33 is usually structured like a rounded rectangle or a circle, and the arrangement manner of the recesses 321 enables the voice coil 33 to be more firmly glued to the bottom wall 321*b* of the recesses 321 even with a small number of recesses 321 in the dome 32. In addition, the spacing 321*a* is provided between every two adjacent recesses 321, and a better balance of the internal and external air pressures of the voice coil 33 can be obtained by the leakage passage 34 formed between the dome 32 and the voice coil 33 at the spacing 321*a*.

Further, a recessing depth H of the recess 321 is between 10 μm and 3000 μm. The recessing depth is a distance by which the recess extends from the dome 32 towards the magnetic circuit unit 2. If the recessing depth H is too small, a dimension of the leakage passage 34 formed between the voice coil 33 and the dome 32 will be too small, which makes it impossible to achieve timely and good circulation effect of the air flow in the voice coil 33. If the recessing depth H is too large, the recess 321 will occupy too much of the space where the voice coil 33 is originally placed, and a volume of the voice coil 33 will be limited greatly, which is disadvantageous for obtaining a large magnetic flux. A width W of the recess 321 is between 100 μm and 1000 μm, which matches a thickness of the voice coil in general conditions. If the width W is too small, a gluing area between the voice coil 33 and the dome 32 will be reduced, and the voice coil 33 cannot be firmly bonded to the dome 32, thereby affecting a reliability of the entire speaker. An excessively large width W does not have a significant influence on the gluing of the voice coil 33, but the case where the recess 321 is arranged to have a relatively large width is unnecessary.

Based on the above structure, in an embodiment, the dome 32 is made of an alloy material such as an aluminum alloy, a magnesium alloy, a magnesium lithium alloy, an aluminum lithium alloy, a titanium alloy, or the like, and the recess 321 is formed by punching the dome 32. In addition, the recess 321 is filled with a damping material such as foam, glue, rubber, wood veneer or the like, which can increase damping of the vibration unit and achieve a further modulation on the performance of the speaker.

Figure 7:
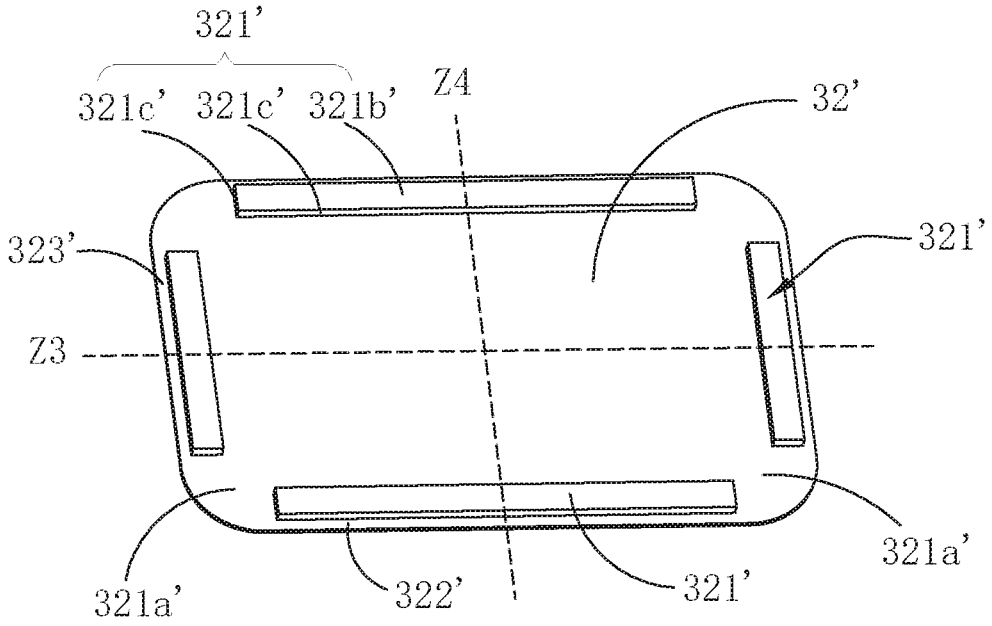
FIG. 7 is a structural diagram of a dome of a speaker according to an embodiment of the present disclosure.
Figure 8:
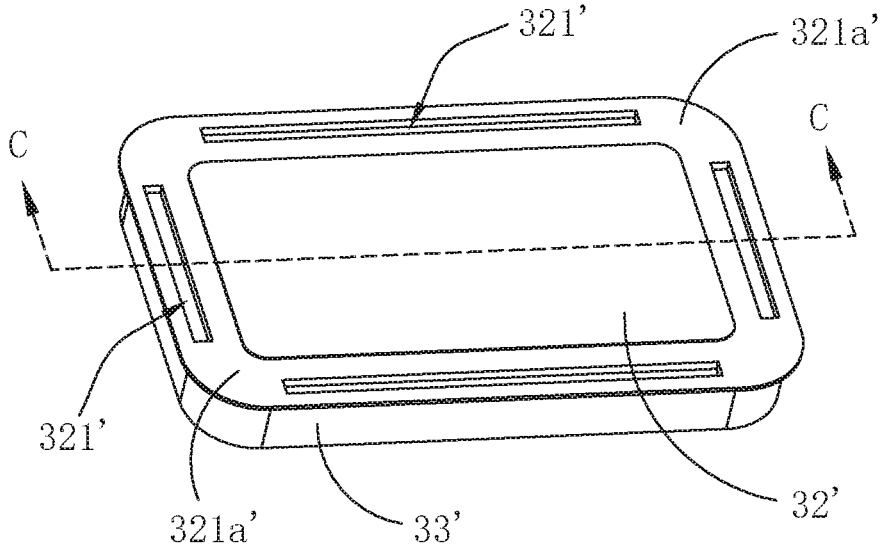
FIG. 8 is a structural diagram of a combination of a dome and a voice diaphragm of a speaker according to an embodiment of the present disclosure.
Figure 9:
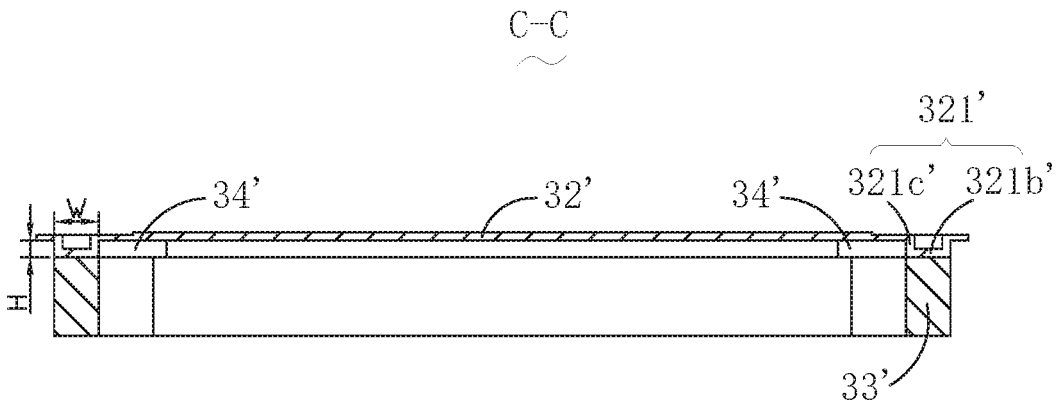
FIG. 9 is a cross-sectional diagram taken along direction C-C of FIG. 8.

FIGS. 7-9 illustrate a structure of a speaker according to an embodiment of the present disclosure. The structure of the speaker of this embodiment is basically the same as the structure of the speaker described above, and the difference lies in that a recess 321' includes sidewalls 321*c*' extending from a dome 32' towards the magnetic circuit unit, and the sidewalls 321*c*' and a bottom wall 321*b*' together define the recess 321'. Two oppositely arranged sidewalls 321*c*' of the sidewalls 321*c*' are parallel to each other. Each of the four recesses 321' is parallel with a long-axis edge 322' or a short-axis edge 323' where it is located. The two recesses 321' located in the long-axis edges 322' are symmetrically distributed about a perpendicular bisector Z3 of the short-axis edges 323', and the two recesses 321' located in the short-axis edges 323' are symmetrically distributed about a perpendicular bisector Z4 of the long-axis edges 322'. Two adjacent recesses 321' are not connected to each other, and a spacing 321*a*' is provided between them. The voice coil 33' abuts against the bottom wall 321*b*' of the recess 321' and forms a leakage passage 34' with the dome 32' at a position where the recesses 321' form the spacing 321*a*'.

In summary, since the recesses recessing towards the magnetic circuit unit are provided in the dome, and the spacing is formed between at least two of the recesses, and the voice coil abuts against the bottom walls of the recesses and forms leakage passages with the dome at the position where the recesses form the spacing, such that the air flow in the voice coil can be circulated in time through the leakage passages located between the voice coil and the dome, and the difference of the internal and external air pressures of the voice coil can be effectively reduced after the amplitude of the vibration unit is increased, thereby avoiding the influence of the imbalance of the internal and external air pressures of the voice coil on the performance of the speaker. Moreover, compared with the case where the voice coil directly abuts the diaphragm, the arrangement of the recesses occupies a part of the space where the voice coil is originally placed, and the voice coil becomes short and thick, which reduces the thickness of the speaker while increasing the magnetic flux; and the arrangement of the recesses on the dome also enhances the structural strength of the dome itself. Therefore, the structure of the speaker of the present disclosure can maintain good and reliable performance even in the case of miniaturization of the speaker.

What has been described above are merely embodiments of the present disclosure, and it should be noted herein that those skilled in the art can make improvements without departing from the inventive concept of the present disclosure, but these are all within the scope of the present disclosure.

What is claimed is:

1. A speaker, comprising:

a holder;

a magnetic circuit unit arranged in the holder; and a vibration unit arranged in the holder, wherein the vibration unit comprises a suspension fixed at the holder, a dome fixed at a center of the suspension and a voice coil connected to the dome, wherein the dome is provided with a plurality of recesses formed by recessing from the dome towards the magnetic circuit unit, a spacing is formed between the plurality of recesses, each of the plurality of recesses comprises a bottom wall, and the voice coil abuts against bottom walls of the plurality of recesses and forms a leakage passage with the dome at the spacing.

2. The speaker as described in claim 1, wherein the dome is a rounded rectangular structure and comprises long-axis edges opposite to each other and short-axis edges connecting the long-axis edges, the plurality of recesses is provided in rims of the long-axis edges and the short-axis edges of the dome, and the spacing is located between two adjacent ones of the plurality of recesses.

3. The speaker as described in claim 2, wherein each of the plurality of recesses further comprises sidewalls extending from the dome towards the magnetic circuit unit, the sidewalls and the bottom wall together define the recess, the sidewalls comprises two first sidewalls opposite to each other and inclined towards a geometric center of the dome and second sidewalls that connect the first sidewalls, and planes in which the two first sidewalls are located intersect inside the dome.

4. The speaker as described in claim 2, wherein each of the plurality of recesses further comprises sidewalls extending from the dome towards the magnetic circuit unit, the sidewalls and the bottom wall together define the recess, and two opposite ones of the sidewalls are parallel with each other.

5. The speaker as described in claim 3, wherein the plurality of recesses comprises four recesses, and the four recesses are symmetrically distributed about a perpendicular bisector of the long-axis edges and a perpendicular bisector of the short-axis edges, respectively.

6. The speaker as described in claim 4, wherein the plurality of recesses comprises four recesses, and the four recesses are symmetrically distributed about a perpendicular bisector of the long-axis edges and a perpendicular bisector of the short-axis edges, respectively.

7. The speaker as described in claim 5, wherein an extending direction of each of the four recesses is parallel with one long-axis edge or one short-axis edge where the recess is located.

8. The speaker as described in claim 6, wherein an extending direction of each of the four recesses is parallel with one long-axis edge or one short-axis edge where the recess is located.

9. The speaker as described in claim 7, wherein a recessing depth of each of the four recesses is between 10 μm and 3000 μm.

10. The speaker as described in claim 8, wherein a recessing depth of each of the four recesses is between 10 μm and 3000 μm.

11. The speaker as described in claim 7, wherein a width of each of the four recesses is between 100 μm and 1000 μm.

12. The speaker as described in claim 8, wherein a width of each of the four recesses is between 100 μm and 1000 μm.

13. The speaker as described in claim 1, wherein the dome is made of an alloy material selected from a group consisting of an aluminum alloy, a magnesium alloy, a magnesium lithium alloy, an aluminum lithium alloy and a titanium alloy, and the plurality of recesses is formed by punching the dome.

14. The speaker as described in claim 1, wherein each of the plurality of recesses is filled with a damping material selected from a group consisting of foam, glue, rubber and wood veneer.

* * * * *